US009816471B2

(12) United States Patent
Shiba et al.

(10) Patent No.: US 9,816,471 B2
(45) Date of Patent: Nov. 14, 2017

(54) FUEL INJECTION PUMP

(71) Applicant: YANMAR CO., LTD., Osaka (JP)

(72) Inventors: Yuji Shiba, Osaka (JP); Masaki Nankou, Osaka (JP); Tomoyuki Kimura, Osaka (JP)

(73) Assignee: YANMAR CO., LTD., Osaka (JP)

( * ) Notice: Subject to any disclaimer, the term of this patent is extended or adjusted under 35 U.S.C. 154(b) by 311 days.

(21) Appl. No.: 14/415,882

(22) PCT Filed: Mar. 27, 2013

(86) PCT No.: PCT/JP2013/058972
§ 371 (c)(1),
(2) Date: Jan. 20, 2015

(87) PCT Pub. No.: WO2014/013758
PCT Pub. Date: Jan. 23, 2014

(65) Prior Publication Data

US 2015/0204290 A1 Jul. 23, 2015

(30) Foreign Application Priority Data

Jul. 20, 2012 (JP) ..... 2012-161933

(51) Int. Cl.
*F02M 53/02* (2006.01)
*F02M 59/42* (2006.01)
(Continued)

(52) U.S. Cl.
CPC ..... *F02M 53/02* (2013.01); *F02M 53/00* (2013.01); *F02M 59/42* (2013.01); *F02M 59/44* (2013.01);
(Continued)

(58) Field of Classification Search
CPC ..... F02M 53/02; F02M 53/00; F02M 59/42; F02M 59/44; F02M 63/0001;
(Continued)

(56) References Cited

U.S. PATENT DOCUMENTS 4,180,036 A * 12/1979 Wolf ..... F02M 31/16 123/557
4,326,491 A * 4/1982 Burchett ..... F02M 31/16 123/552
(Continued)

FOREIGN PATENT DOCUMENTS

EP 1580415 A1 9/2005
JP 6070735 U 5/1985
(Continued)

OTHER PUBLICATIONS

International Search Report corresponding to International Application No. PCT/JP2013/058972; dated Jul. 2, 2013; with English translation.
(Continued)

*Primary Examiner* — Thomas Moulis
*Assistant Examiner* — John Bailey
(74) *Attorney, Agent, or Firm* — Cantor Colburn LLP

(57) ABSTRACT

Provided is a configuration which prevents an engine from being unable to start in the state in which dew condensation occurred in a fuel injection pump and froze. The present invention relates to a fuel injection pump which is provided with a pump body and a hydraulic head and driven by an engine, and is characterized in that while the engine is in operation, the temperature of the hydraulic head is increased to a dew-point temperature or higher. Consequently, it is possible to increase the temperature of the hydraulic head and remove water in the fuel injection pump while the engine is in operation. Accordingly, the engine can be
(Continued)

prevented from being unable to start in the state that dew condensation occurred in the fuel injection pump and froze.

9 Claims, 11 Drawing Sheets

(51) Int. Cl.
*F02M 53/00* (2006.01)
*F02M 59/44* (2006.01)
*F02M 63/00* (2006.01)
*F04B 53/04* (2006.01)

(52) U.S. Cl.
CPC ..... *F02M 63/0001* (2013.01); *F04B 53/04* (2013.01); *F04B 2201/0801* (2013.01)

(58) Field of Classification Search
CPC ..... F02M 59/28; F02M 63/00; F04B 53/04; F04B 2201/0801; F01P 1/06
USPC ..... 123/495, 366, 508, 41.04, 41.02, 41.2, 123/41.21, 41.31, 41.82 R; 74/838; 417/434, 173
See application file for complete search history.

(56) References Cited

U.S. PATENT DOCUMENTS 4,483,305 A * 11/1984 Gilmor ..... F02M 31/18 123/557
6,179,577 B1 * 1/2001 Meyer ..... F02M 31/125 123/557
6,397,822 B1 * 6/2002 Ulm ..... F02M 31/20 123/25 R
6,857,419 B1 * 2/2005 Harvey ..... B01D 53/002 123/41.31
7,004,117 B2 * 2/2006 Grant ..... F04B 43/02 123/41.31
7,013,878 B1 * 3/2006 Cotton ..... F02M 37/20 123/41.31
2002/0040740 A1 4/2002 Ozawa
2002/0127119 A1 9/2002 Ono et al.
2002/0139111 A1 * 10/2002 Ueda ..... B01D 61/36 60/285
2002/0170508 A1 * 11/2002 Joos ..... F01P 1/06 123/41.31
2003/0196723 A1 10/2003 Ozawa
2004/0103858 A1 * 6/2004 Shetley ..... F02B 43/08 123/3
2012/0103284 A1 * 5/2012 Achor ..... F02M 31/20 123/41.31
2013/0118458 A1 * 5/2013 Kojima ..... F02D 19/022 123/552

FOREIGN PATENT DOCUMENTS

JP 61200376 A * 9/1986
JP H08128335 A 5/1996
JP 10184494 A 7/1998
JP 2001003839 A 1/2001
JP 2001050549 A 2/2001
JP 2002114242 A 4/2002
JP 2008202441 A * 9/2008
JP 2008240531 A * 10/2008
JP 2009287529 A 12/2009
JP 4676966 B2 4/2011

OTHER PUBLICATIONS

Extended European Search Report corresponding to Application No. 13819310.7-1603/2876296 PCT/JP2013/058972; dated Feb. 16, 2016.
European Office Action for corresponding EP Application No. 13819310.7-1603; dated Jun. 20, 2017.

* cited by examiner

FUEL INJECTION PUMP

CROSS REFERENCE TO RELATED APPLICATIONS

This is the U.S. national stage of application No. PCT/JP2013/058972, filed on Mar. 27, 2013. Priority under 35 U.S.C. §119(a) and 35 U.S.C. §365(b) is claimed from Japanese Application No. JP2012-161933, filed Jul. 20, 2012, the disclosure of which is also incorporated herein by reference.

TECHNICAL FIELD

The present invention relates to a fuel injection pump.

BACKGROUND ART

JP H08-128335 A discloses a fuel injection pump including a hydraulic head with a rack chamber in which a control rack is located.

CITATION LIST

Patent Literature

PTL 1: JP H08-128335 A

SUMMARY OF INVENTION

Technical Problem

In the housing of the fuel injection pump, dew condensation may occur due to moisture or a vapor contained in a blow-by gas. For instance, if the engine is stopped in a condition that temperature of the rack chamber is between 0° C. and a dew point, the dew condensation occurs in the rack chamber. If outside temperature becomes lower than a freezing point, the droplets caused by the dew condensation are frozen, whereby the control rack cannot be actuated.

The present invention aims to provide a technique of preventing dew condensation in the fuel injection pump and preventing the engine from being unable to start in the state that the dew condensation are frozen.

Technical Solutions

The present invention relates to a fuel injection pump including a pump body and a hydraulic head, which is actuated by an engine, and in which during the engine is operated, a temperature of the hydraulic head is increased to not less than a dew point.

Due to the structure, after starting the engine, the hydraulic head is rose in temperature and the water in the fuel injection pump is vaporized, whereby the water would not be remained in the hydraulic head. Accordingly, the dew condensation in the fuel injection pump can be prevented, and the internal members would not be frozen, thereby securing the startability of the engine.

In a first embodiment of the fuel injection pump, a water passage of a cooling water for the engine is branched off such that the cooling water contacts a member disposed at an outer face of the hydraulic head, and the member is rose in temperature using the cooling water the temperature of which is increased as an engine operation to heat the hydraulic head.

Preferably, in the first embodiment, the water passage is provided with a switch valve for bypassing the passage branched off toward the member disposed in the hydraulic head, and if the temperature of the hydraulic head is increased to not less than a predetermined temperature, the switch valve is operated to shut the flow of the cooling water into the member disposed in the hydraulic head.

In a second embodiment of the fuel injection pump, in the hydraulic head, a water channel for circulating the cooling water is formed, and the temperature of the hydraulic head is increased by using the cooling water the temperature of which is increased as the engine operation.

Preferably, in the second embodiment, the water passage is provided with a switch valve for bypassing the water channel, and if the temperature of the hydraulic head is increased to not less than a predetermined temperature, the switch valve is operated to shut the flow of the cooling water into the water channel.

In a third embodiment of the fuel injection pump, an oil passage of a lubricant oil fed to the fuel injection pump is branched off such that the lubricant oil contacts a member disposed at an outer face of the hydraulic head, and the member is rose in temperature using the lubricant oil the temperature of which is increased as an engine operation to heat the hydraulic head.

In a forth embodiment of the fuel injection pump, in the hydraulic head, an oil passage for circulating a lubricant oil fed to the fuel injection pump is formed, and the temperature of the hydraulic head is increased by using the lubricant oil the temperature of which is increased as an engine operation.

In the third embodiment or forth embodiment, the oil passage is provided with a switch valve for bypassing the oil passage, and if the temperature of the hydraulic head is increased to not less than a predetermined temperature, the switch valve is operated to shut the flow of the lubricant oil into the oil passage.

In a fifth embodiment of the fuel injection pump, the hydraulic head is attached with a heater for heating the hydraulic head.

In the fifth embodiment, if the temperature of the hydraulic head is increased to not less than a predetermined temperature, the heater is stopped.

Advantageous Effects of Invention

According to the present invention, while the engine is in operation, the temperature of the hydraulic head is raised enough to remove moisture in the fuel injection pump. Consequently, the dew condensation in the fuel injection can be prevented and the engine can be prevented from being unable to start due to freezing of the droplets caused by the dew condensation.

DESCRIPTION OF EMBODIMENTS

Figure 1:
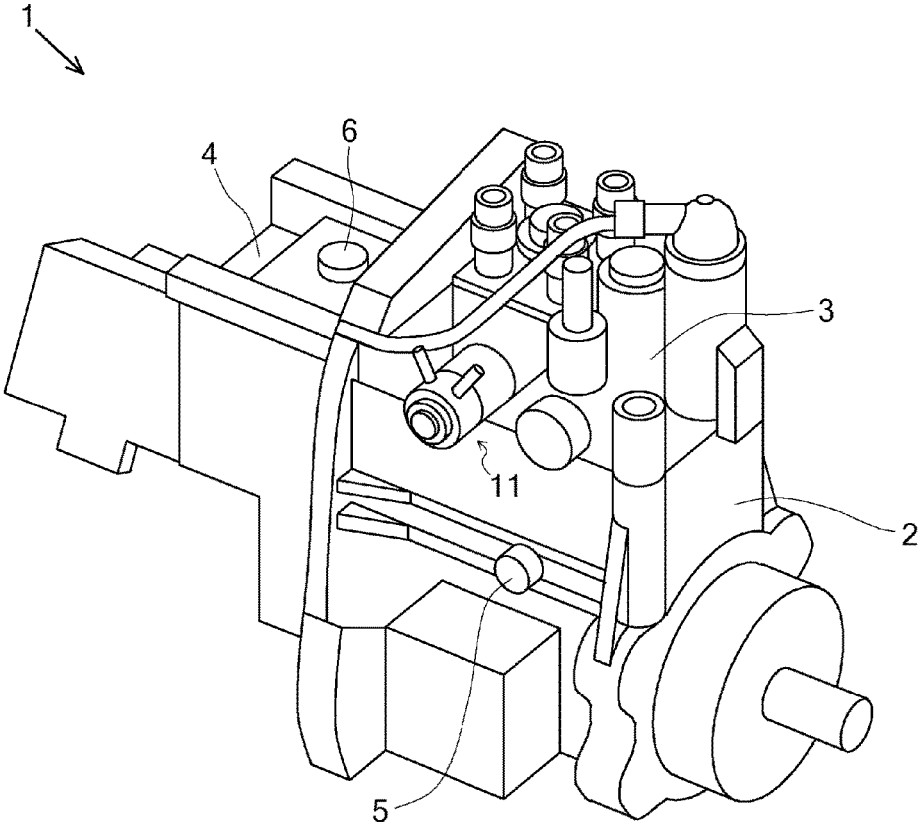
FIG. 1 depicts a fuel injection pump.

FIG. 1 depicts a fuel injection pump 1 which includes a pump body 2 provided with a hydraulic head 3. To the side face of the fuel injection pump 1, a governor 4 for controlling an amount of fuel injection is attached.

In the pump body 2, a cam to which a driving force is transmitted from an engine and a tappet for transmitting the rotation of the cam are installed. In the hydraulic head 3, a plunger which telescopically moves linked with the tappet and a control rack rotating the plunger to change the amount of fuel injection are installed.

First Embodiment

Figure 2:
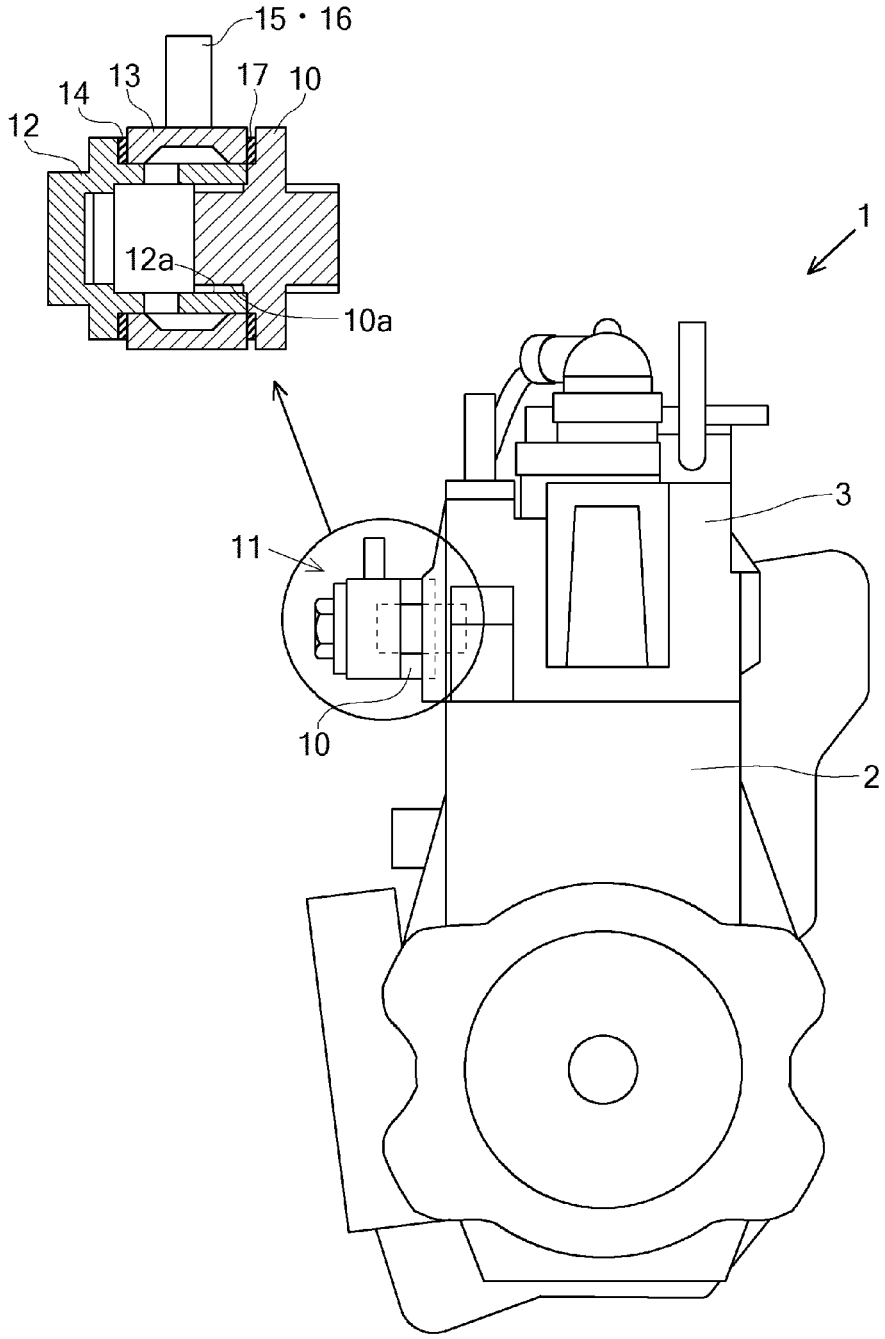
FIG. 2 illustrates a first embodiment of the fuel injection pump.

As shown in FIG. 2, to the side face of the hydraulic head 3, a plug 10 is attached. The plug 10 is a shutting member for a through hole which is formed to assemble a fuel filter and the like inside of the hydraulic head 3, and the plug is located in the vicinity of a rack chamber in which the control rack is disposed.

As shown in FIG. 2, at one end of the plug 10, a male thread is formed to fix the plug to the through hole of the side of the hydraulic head 3, and at the other end of the plug, a male thread 10*a* is formed projecting outside of the hydraulic head 3.

The plug 10 is attached with a channel member 11. The channel member 11 includes a female thread corresponding to the male thread 10*a* of the plug 10, and the female thread of the channel member 11 is threaded to the male thread of the plug 10, thereby fixing the channel member to the plug.

Figure 3:
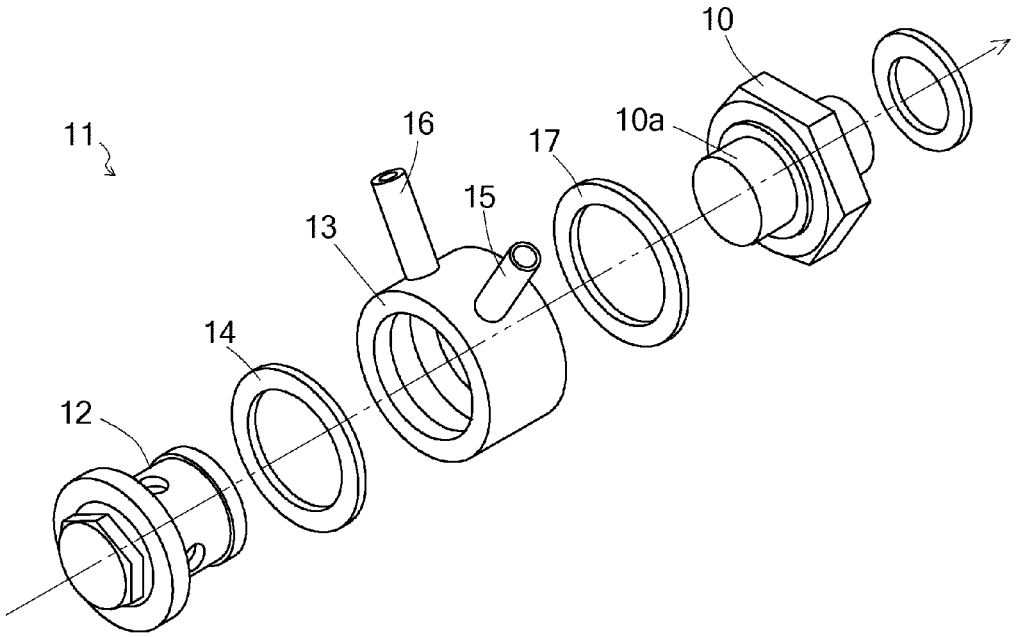
FIG. 3 is an exploded perspective view of a channel member.

As shown in FIGS. 2 and 3, the channel member 11 includes a fixing portion 12 and a channel portion 13. The channel member 11 is fixed to the hydraulic head 3 by threading the fixing portion 12 to the plug 10 in a state that the channel portion 13 and O-ring 14 are sandwiched with respect to the plug 10.

The fixing portion 12 includes a thread portion having a tube shape opening one end, and is, in the opening end, formed with a female thread 12*a* corresponding to the male thread 10*a* of the plug 10. The side of the tube shape of the fixing portion is formed with multiple through holes, whereby inside and outside of the fixing portion are communicated with each other.

The channel portion 13 covers the fixing portion 12, and thus faces the plug 10, thereby forming sealed internal space. At the outer periphery of the channel portion 13, an inlet 15 and an outlet 16 are formed. Through the inlet 15 and outlet 16, fluid such as water or oil can flow into the inside space of the channel member 11.

The O-rings 14 and 17 are located between the fixing portion 12 and the channel portion 13 and between the channel portion 13 and the plug 10, respectively, and thus the channel member 11 is sealed.

The water passage of the cooling water for the engine is branched off to the channel member 11. To the inlet 15 and outlet 16, a branch passage 18 is connected, and the cooling water passed through a cylinder head and the like which are members of the engine flows into the channel member 11 via the branch passage 18. The heat of the cooling water introduced in the internal space of the channel member 11 is transferred to the hydraulic head 3 via the plug 10.

Figure 4:
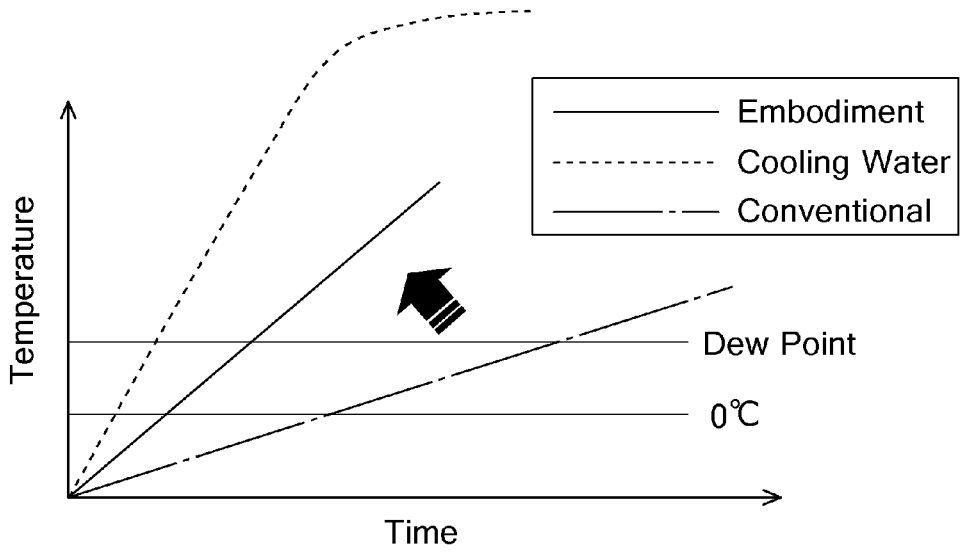
FIG. 4 is a graph showing temperature rises in members of an engine, while the operation of the engine.

FIG. 4 depicts temperature rises while the operation of the engine. The solid line represents the temperature rise of the hydraulic head 3 where the cooling water is flown into the channel member 11, and the chain line represents the temperature rise of the hydraulic head (conventional structure) where the cooling water is not flown into the channel member 11. The broken line represents the temperature rise of the cooling water.

As shown in FIG. 4, as the engine is operated, the temperature of the cooling water is rose faster than the hydraulic head 3. The heat of the cooling water is transferred to the hydraulic head 3 through the channel member 11 and the plug 10, and therefore, the temperature of the hydraulic head 3 is increased indirectly.

Due to the above-described structure, if the engine is started in a situation that the outside temperature is low (e.g., around −20° C.) such as in cold district, the temperature of the hydraulic head 3 is increased by the same speed as the cooling water for the engine. Consequently, the hydraulic head can be rose in temperature above the dew point in a short time after the engine operation is started.

Thus, the temperature of the hydraulic head 3 is increased to not less than the dew point while the engine is in operation, and the engine can be stopped where the water is not remained, which can avoid the situation that the remained water will be frozen. Therefore, the engine can be prevented from being unable to start due to the freezing.

By means of the plug 10 as one member attached to the outside of the hydraulic head 3, the temperature of the hydraulic head 3 is indirectly increased, so that the present embodiment can be easily installed in the conventional structures.

Moreover, the hydraulic head 3 is heated via the plug 10 located near the control rack, so that the temperature around the control rack can be increased preferentially. Accordingly, the control rack can be prevented from freezing, thereby avoiding engine problems in fuel injection system.

In the hydraulic head 3, the heat can be transferred from the inside of the plug 10, so that the hydraulic head 3 can be heated effectively.

Figure 5:
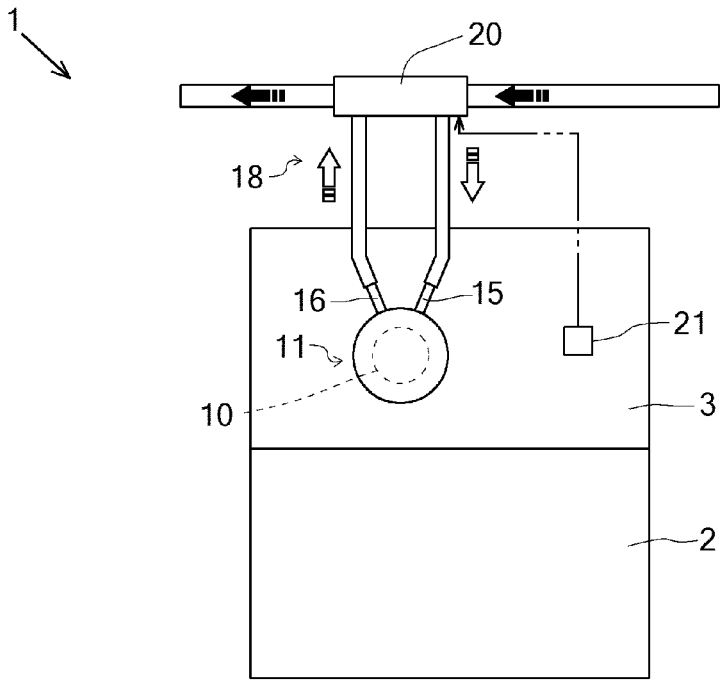
FIG. 5 illustrates a switching structure of cooling water flown to the channel member.

As illustrated in FIG. 5, at a junction of the cooling water passage branched off toward the channel member 11, a switch valve 20 is disposed to switch the passage. The switch valve 20 is an electromagnetic valve configured to shut the flow toward the channel member 11 and bypass the channel member 11. The hydraulic head 3 is provided with a temperature sensor 21 for detecting the temperature of the hydraulic head 3. The temperature sensor 21 measures the surface temperature of the hydraulic head 3 and transmits the control signal to the switch valve 20 in accordance with the measured temperature, thereby controlling that operation.

More specifically, if the measured temperature detected by the temperature sensor 21 is not less than a predetermined temperature above the dew point, the switch valve 20 is operated, and the branch passage for the channel member 11 is bypassed and the flow of the cooling water toward the channel member 11 is shut. Thus, the overheating by the cooling water can be prevented, and the temperature of the hydraulic head 3 can be prevented from being excessively increased.

Second Embodiment

Figure 6:
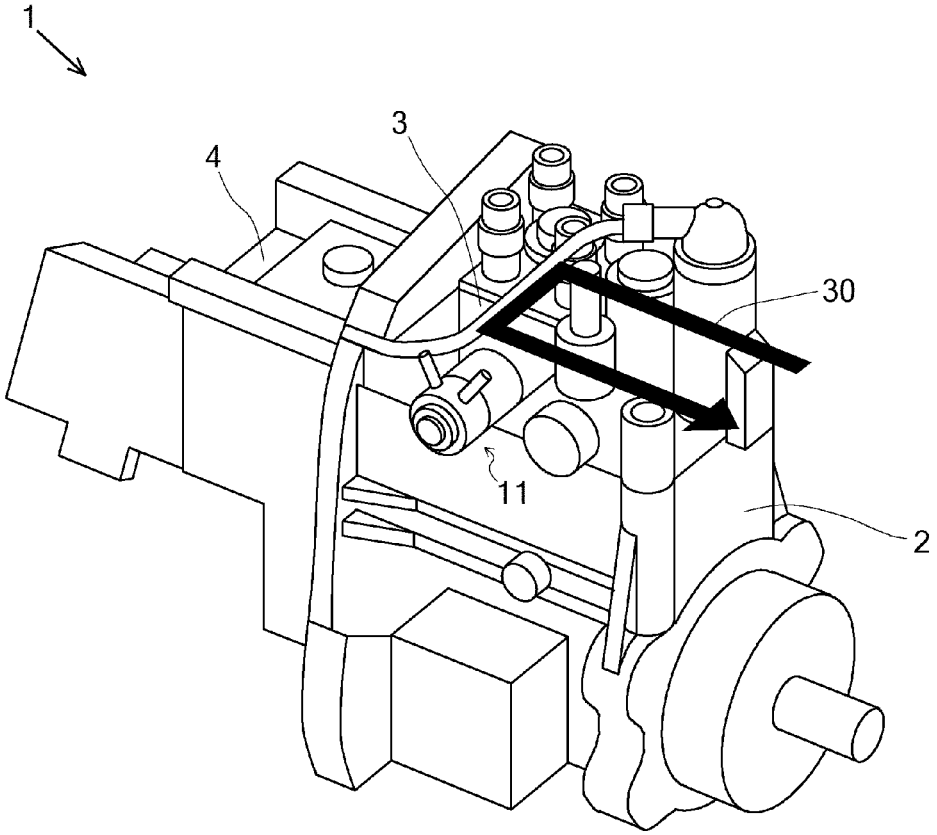
FIG. 6 illustrates a second embodiment of the fuel injection pump.

As illustrated in FIG. 6, the hydraulic head 3 is formed with a water channel 30. The water channel 30 is disposed so as to round the hydraulic head 3 viewed from top. In other words, the water channel 30 is formed in all areas of the hydraulic head 3 viewed from top.

The water channel 30 is connected to the branch passage branched off from the cooling water passage for the engine via a junction, and the cooling water can be flown through the water channel 30. The heat of the cooling water introduced into the water channel 30 is transferred to the hydraulic head 3.

Due to the above-described structure, if the engine is started in a situation that the outside temperature is low (e.g., around −20° C.) such as in cold district, the temperature of the hydraulic head 3 is increased with the same speed as the cooling water for the engine. Consequently, the temperature of the hydraulic head can be increased to not less than the dew point in a short time after the engine operation is started.

Thus, the temperature of the hydraulic head 3 is increased to not less than the dew point while the engine is in operation, and the engine can be stopped where the water is not remained, which can avoid the situation that the remained water will be frozen. Therefore, the engine can be prevented from being unable to start due to the freezing.

Figure 7:
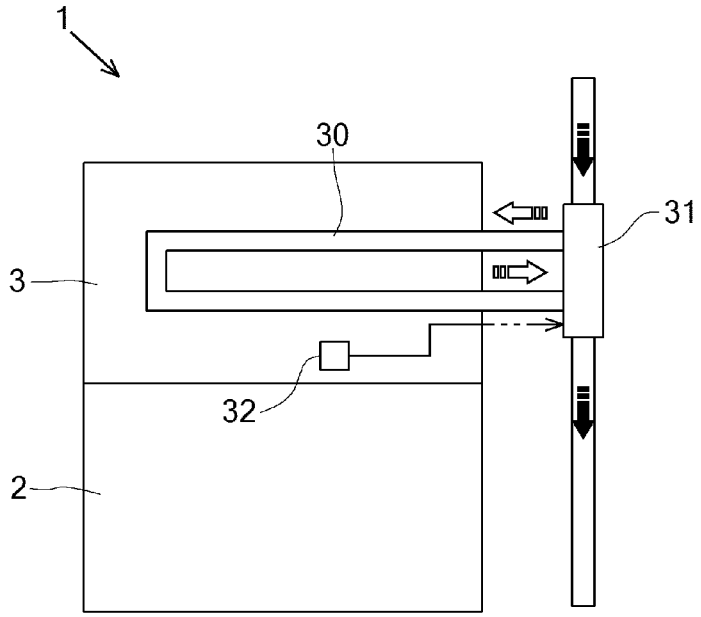
FIG. 7 illustrates a switching structure of cooling water flown to a water channel.

As illustrated in FIG. 7, at the junction of the cooling water passage branched off toward the water channel 30, a switch valve 31 is disposed to switch the passage. The switch valve 31 is an electromagnetic valve configured to shut the flow toward the water channel 30 and bypass the water channel 30. The hydraulic head 3 is provided with a temperature sensor 32 for detecting the temperature of the hydraulic head 3. The temperature sensor 32 measures the surface temperature of the hydraulic head 3 and transmits the control signal to the switch valve 31 in accordance with the measured temperature, thereby controlling that operation.

More specifically, if the measured temperature detected by the temperature sensor 32 is not less than a predetermined temperature above the dew point, the switch valve 31 is operated, and the branch passage for the water channel 30 is bypassed and the flow of the cooling water toward the water channel 30 is shut. Thus, the overheating by the cooling water can be prevented, and the temperature of the hydraulic head 3 can be prevented from being excessively increased.

As illustrated in FIG. 6, the structure according to the second embodiment using the water channel 30 which directly heats the hydraulic head 3 from inside can be employed with the structure according to the first embodiment using the channel member 11 which indirectly heats the hydraulic head 3. In such structure, the switch valves 20 and 31 can be communalized.

Third Embodiment

Figure 8:
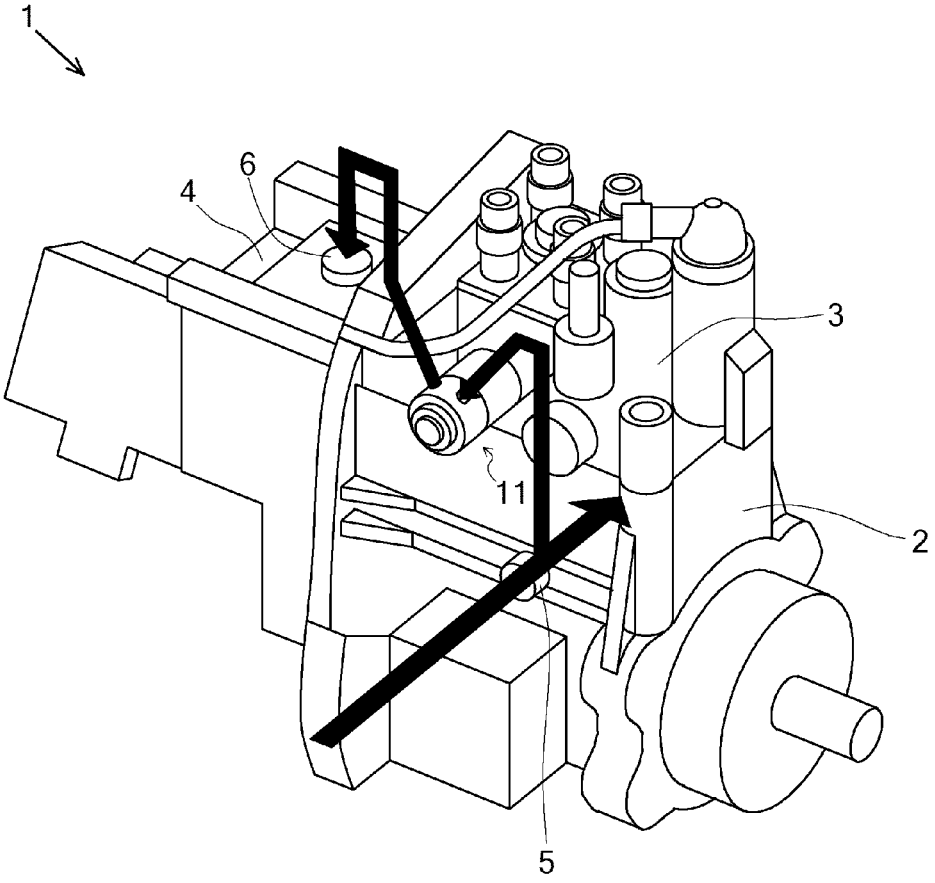
FIG. 8 illustrates a third embodiment of the fuel injection pump.

As illustrated in FIG. 8, through the channel member 11, lubricant oil is fed, and the hydraulic head 3 is heated by the temperature of the lubricant oil is increased as the engine is operated.

In this embodiment, from the oil inlet 5 for the fuel injection pump 1, the oil passage is branched off toward the inlet 12 of the channel member 11, and the outlet 13 of the channel member 11 is connected to the oil inlet 6 of the governor 4.

As the engine is operated, the temperature of the lubricant oil fed to the fuel injection pump 1 is rose faster than the hydraulic head 3. The heat of the lubricant oil is transferred to the hydraulic head 3 through the channel member 11 and the plug 10, and therefore, the temperature of the hydraulic head 3 is increased indirectly.

Due to the above-described structure, if the engine is started in a situation that the outside temperature is low (e.g., around −20° C.) such as in cold district, the temperature of the hydraulic head 3 is increased by the same speed as the lubricant oil for the engine. Consequently, the hydraulic head can be rose in temperature above the dew point in a short time after the engine is started to be operated.

Thus, the temperature of the hydraulic head 3 is increased not less than the dew point during operating the engine, and the engine can be stopped in the condition that the water is not remained, which can avoid the situation that the remained water will be frozen. Therefore, the engine can be prevented from being unable to start due to the freezing.

Figure 9:
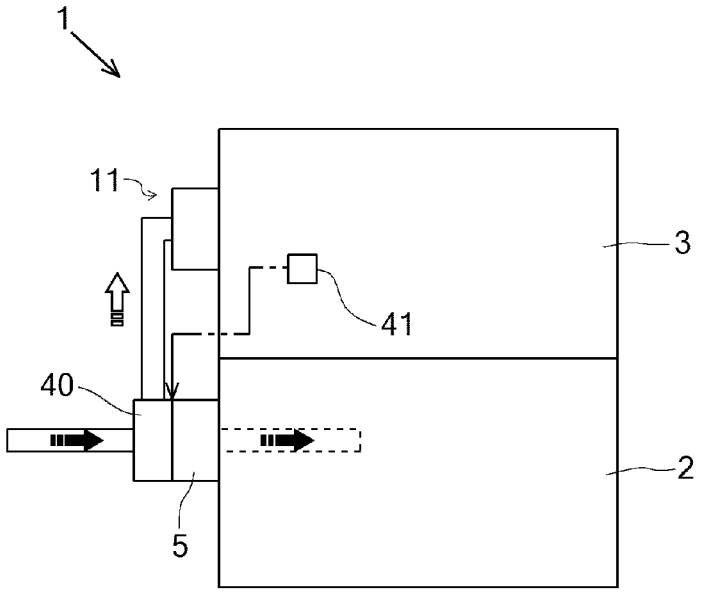
FIG. 9 illustrates a switching structure of lubricant oil flown to the channel member.

As illustrated in FIG. 9, at a junction of the lubricant oil passage branched off toward the oil inlet 5, a switch valve 40 is disposed to switch the passage. The switch valve 40 is an electromagnetic valve configured to shut the flow of the lubricant oil toward the channel member 11 and bypass the channel member 11. The hydraulic head 3 is provided with a temperature sensor 41 for detecting the temperature of the hydraulic head 3. The temperature sensor 41 measures the surface temperature of the hydraulic head 3 and transmits the control signal to the switch valve 40 in accordance with the measured temperature, thereby controlling that operation.

More specifically, if the measured temperature detected by the temperature sensor 41 is not less than a predetermined temperature above the dew point, the switch valve 40 is operated, and the branch passage for the channel member 11 is bypassed and the flow of the lubricant oil toward the channel member 11 is shut. Thus, the overheating by the lubricant oil can be prevented, and the temperature of the hydraulic head 3 can be prevented from being excessively increased.

Fourth Embodiment

Figure 10:
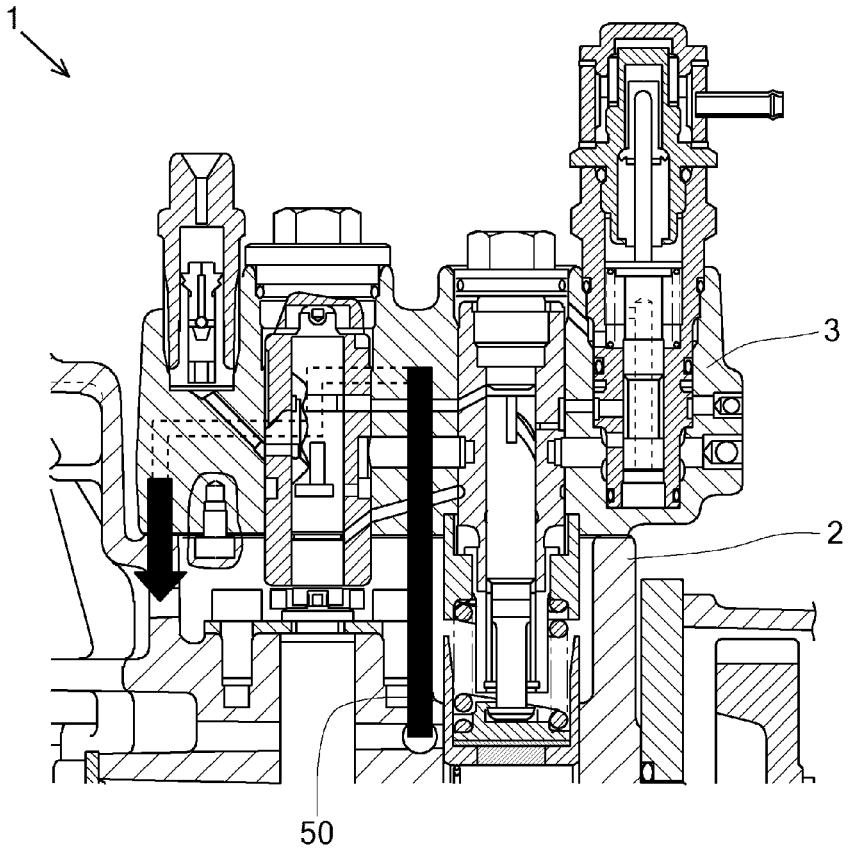
FIG. 10 illustrates a forth embodiment of the fuel injection pump.

As shown in FIG. 10, the hydraulic head 3 is provided with an oil passage 50. The oil passage 50 is an additional oil passage with respect to the lubricant oil passages which are installed in the hydraulic head 3. The oil passage is branched off from the lubricant oil passage connected to the oil inlet 5 for the fuel injection pump 1.

The oil passage 50 is formed so as to pass the vicinity of the rack chamber containing the control rack. Thus, the rack chamber can be heated effectively, and the dew condensation of the control rack can be prevented.

With operating the engine, the temperature of the lubricant oil fed to the fuel injection pump 1 is increased drastically. Such high-temperature lubricant oil passes through the oil passage 50, and the heat of the lubricant oil is transferred to the hydraulic head 3, whereby the hydraulic head 3 is directly heated from inside thereof.

Due to the above-described structure, if the engine is started in a situation that the outside temperature is low (e.g., around −20° C.) such as in cold district, the temperature of the hydraulic head 3 is increased by the same speed as the lubricant oil for the engine. Consequently, the hydraulic head can be rose in temperature above the dew point in a short time after the engine operation is started.

Thus, the temperature of the hydraulic head 3 is increased not less than the dew point while the engine is in operation, and the engine can be stopped where the water is not remained, which can avoid the situation that the remained water will be frozen. Therefore, the engine can be prevented from being unable to start due to the freezing.

Figure 11:
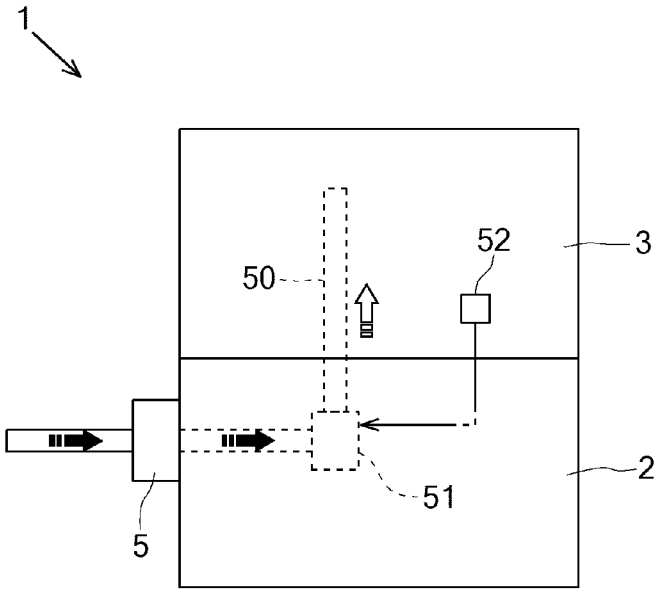
FIG. 11 illustrates a switching structure of lubricant oil flown to an oil passage.

As illustrated in FIG. 11, at a junction of the lubricant oil passage branched off toward the oil passage 50 in the hydraulic head 3, a switch valve 51 is disposed to switch the passage. The switch valve 51 is an electromagnetic valve configured to shut the flow of the lubricant oil toward the oil passage 50 and bypass the oil passage 50. The hydraulic head 3 is provided with a temperature sensor 52 for detecting the temperature of the hydraulic head 3. The temperature sensor 52 measures the surface temperature of the hydraulic head 3 and transmits the control signal to the switch valve 51 in accordance with the measured temperature, thereby controlling that operation.

More specifically, if the measured temperature detected by the temperature sensor 52 is not less than a predetermined temperature above the dew point, the switch valve 51 is operated, and the branch passage for the oil passage 50 is bypassed and the flow of the lubricant oil toward the oil passage 50 is shut. Thus, the overheating the hydraulic head by the lubricant oil can be prevented, and the temperature of the hydraulic head 3 can be prevented from being excessively increased.

Fifth Embodiment

Figure 12:
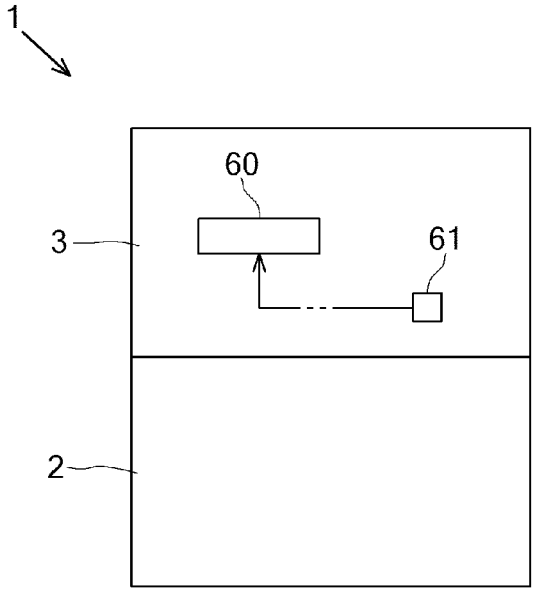
FIG. 12 illustrates a fifth embodiment of the fuel injection pump.

As illustrated in FIG. 12, the hydraulic head 3 is attached with a heater 60. The heater 60 directly heats the hydraulic head 3. The heater 60 works after the engine starts, and heats the hydraulic head 3 while the engine is in operation.

Thus, the hydraulic head 3 is heated to temperature not less than the dew point while the engine is in operation by the heater, and the engine can be stopped where the water is not remained, which can avoid the situation that the remained water will be frozen. Therefore, the engine can be prevented from being unable to start due to the freezing.

The hydraulic head 3 is attached with a temperature sensor 61 for detecting the surface temperature thereof. The temperature sensor 61 measures the surface temperature of the hydraulic head 3 and transmits the control signal to the heater 60 in response to the measured temperature, thereby controlling the operation of the heater.

More specifically, if the measured temperature detected by the temperature sensor 61 is not less than a predetermined temperature above the dew point, the heater 60 is stopped, and the heating of the hydraulic head 3 is stopped. Thus, the overheating by the heater 60 can be prevented, and the temperature of the hydraulic head 3 can be prevented from being excessively increased.

As described above, the heater 60 is operated after the engine operation is started, so that the battery capacity for the heater 60 can be decreased.

In the hydraulic head 3, the heater 60 is located in the vicinity of the rack chamber containing the control rack. Therefore, the rack chamber can be heated effectively, and the dew condensation of the control rack can be prevented.

DESCRIPTION OF NUMERALS

1: fuel injection pump, 2: pump body, 3: hydraulic head, 4: governor, 10: plug, 11: channel member, 12: fixing portion, 13: channel portion, 14: O-ring, 15: inlet, 16: outlet, 17: O-ring, 18: branch passage, 20: switch valve, 21: temperature sensor

The invention claimed is:

1. A fuel injection pump driven by an engine comprising: a pump body; and a hydraulic head, characterized in that a plug is attached to shut a through hole formed in a side face of the hydraulic head, a channel member is attached to the plug, whereby the channel member is attached to an outside of the hydraulic head, the channel member is connected with a branch passage branched off from a water passage of a cooling water for the engine, the cooling water flows through the channel member via the branch passage, and while the engine is operated, the heat of the cooling water introduced into in the channel member is transferred to the hydraulic head via the plug attached to the outside thereof, whereby a temperature of the hydraulic head is increased to or exceeds a dew point.

2. The fuel injection pump according to claim 1, wherein the water passage is provided with a switch valve for bypassing the passage branched off toward the channel member disposed in the hydraulic head, and wherein if the temperature of the hydraulic head is increased to or exceeds a predetermined temperature, the switch valve is operated to shut the flow of the cooling water into the channel member disposed in the hydraulic head.

3. The fuel injection pump according to claim 1, wherein in the hydraulic head, a water channel for circulating the cooling water is formed, and wherein the cooling water is used to heat the hydraulic head, in which the temperature of the cooling water is increased as the engine operation.

4. The fuel injection pump according to claim 3, wherein the water passage is provided with a switch valve for bypassing the water channel, and wherein if the temperature of the hydraulic head is increased to or exceeds a predetermined temperature, the switch valve is operated to shut the flow of the cooling water into the water channel.

5. A fuel injection pump driven by an engine comprising: a pump body; and a hydraulic head, characterized in that a plug is attached to shut a through hole formed in a side face of the hydraulic head, a channel member is attached to the plug, whereby the channel member is attached to an outside of the hydraulic head, the channel member is connected with a branch passage branched off from an oil passage of a lubricant oil fed to the fuel injection pump, the lubricant oil flows through the channel member via the branch passage, and while the engine is operated, the heat of the lubricant oil introduced into in the channel member is transferred to the hydraulic head via the plug attached to the outside thereof, whereby a temperature of the hydraulic head is increased to or exceeds a dew point.

6. The fuel injection pump according to claim 5, wherein in the hydraulic head, the oil passage for circulating the lubricant oil fed to the fuel injection pump is formed, and wherein the lubricant oil is used to heat the hydraulic head, in which the temperature of the lubricant oil is increased as an engine operation.

7. The fuel injection pump according to claim 5, wherein the oil passage is provided with a switch valve for bypassing the oil passage, and wherein if the temperature of the hydraulic head is increased to or exceeds a predetermined temperature, the switch valve is operated to shut the flow of the lubricant oil into the oil passage.

8. The fuel injection pump according to claim 1, wherein the hydraulic head is attached with a heater for heating the hydraulic head.

9. The fuel injection pump according to claim 8, wherein if the temperature of the hydraulic head is increased to or exceeds a predetermined temperature, the heater is stopped.

* * * * *